United States Patent [19]

Bond

[11] 4,356,579

[45] Nov. 2, 1982

[54] BOLSTER TYPE CUSHIONS FOR THERAPEUTIC USE

[76] Inventor: Helen I. Bond, 709 Olson Rd., Longview, Wash. 98632

[21] Appl. No.: 130,830

[22] Filed: Mar. 17, 1980

[51] Int. Cl.[3] ..... A61H 15/00; A47G 9/00

[52] U.S. Cl. ..... 5/431; 5/434; 128/57

[58] Field of Search ..... 5/431, 434, 436, 465, 5/491; D6/201; 128/57, 69, 76 R

[56] References Cited

U.S. PATENT DOCUMENTS

| | | | |
|---|---|---|---|
| D. 257,105 | 9/1980 | Morris | D6/201 |
| 1,882,490 | 10/1932 | Falck | 128/57 |
| 3,129,975 | 4/1964 | Emery | 5/434 |
| 3,419,268 | 12/1968 | Bellet | 128/57 |
| 3,664,334 | 5/1972 | O'Neill | 128/57 |
| 3,719,985 | 3/1973 | Hanes | 5/436 |
| 3,842,453 | 10/1974 | Redfield | 5/436 |
| 3,888,241 | 6/1975 | Fischer | 128/57 |
| 3,974,532 | 8/1976 | Ecchuya | 5/465 |
| 4,081,870 | 4/1978 | Iannucci | 5/434 |
| 4,218,792 | 8/1980 | Kogan | 5/436 |

*Primary Examiner*—Alexander Grosz

*Attorney, Agent, or Firm*—George R. Nimmer

[57] ABSTRACT

Disclosed are bolster type cushions for therapeutic use, such as for patients reclining in a sleeping bed, convalescents utilizing chair-like supports, etc. The bolster type cushions are provided with apt handle means thereby affording ready manipulation by nurses or other attendant personnel and further provided with water-proof jacket means whereby the cushion might be immersed or otherwise liberally cleansed without seapage of water into the porous body of the cushion. Also disclosed are treads and other means for stabilizing the cushion at the therapeutic environment. The bolster type cushions might be provided with leadwardly tapered form to facilitate insertion into sleeved therapeutic devices. Disclosed also are cushion cross-sectional shapes adapted to permit removably secure engagement within a cross-sectionally smaller and desireably firmer bolster cushion, the dual-cushions combination having advantages for specific patient needs.

7 Claims, 13 Drawing Figures

28
27E
27
25D
25D
25D
25

20R
37
28R
25
20A
27R
3A
20R
27R
28R
25
21
37

25D
26T
26
25
20
20A
27
28
25
23

3
10
3
28
26
20A 10
4
5
10
26T
28
26
20A
25
27E
26T 12
26T
26
28
20A
250
26T
216
210
217
12

7
7
20A
27
28
21
22
23

20A
21
26T
23

7
7
6
6
6
6

BOLSTER TYPE CUSHIONS FOR THERAPEUTIC USE

Prior art workers in the patient care field have long recognized the bolster type cushions might be advantageously employed for various therapeutic purposes. Among the general prior art teaching therapeutic benefit of bolster type cushions are U.S. Pat. Nos. 3,924,282 and 4,074,376. However, several disadvantages and deficiencies of prior art bolster type cushions have long plagued medical attendants and others in the patient care industry. Prior art bolsters are oftentimes difficult to manipulate and maneuver by attendants within the constraints of the environment immediately adjacent the patient to be cared for. Bolsters of the prior art are invariably of circular cross-sectional shape, and hence, not amenable to exigencies which might arise for special patient needs. Moreover, the problem of cleansing the bolsters from patient secretory matter, without ancillary damage to the cushion resiliency, has continually troubled prior art workers.

It is accordingly the general objective of the present invention to provide bolster type cushions which overcome the several disadvantages and deficiencies of prior art bolsters. Among the general objectives is the provision of bolster type cushions which have unusually good handling and manipulative characteristics within various therapeutic environments, that are immersible into or otherwise readily liberally cleansed by liquid cleaning agents without ancillary seapage into the pores of the cushion resilient body, and that might be made into apt cross-sectional geometric shapes to enhance the therapeutic versatility thereof.

With the above and other objects and advantages in view, which will become more apparent as this description proceeds, the bolster type cushions of the present invention are provided with novel handle means relegated to the cushion rearward end to enhance maneuvering and manipulation by attendants; water-proof jacket means extending along the entire cushion surface to permit immersion or other liberal liquid-type cleansing without ancillary seapage into the pores of the cushion body, the jacket means preferably taking the densified form of a resiliently compressible foamy resinous material; and an optionally sidewardly channeled bolster to permit removably secure insertion of a smaller and desireably firmer bolster, thereby affording utilitarian advantages for special patient needs.

In the drawing, wherein like characters refer to like parts in the several views, and in which.

Figures 1, 2, 2A, 3, 3A, 4, 5, 8, 9, 11:
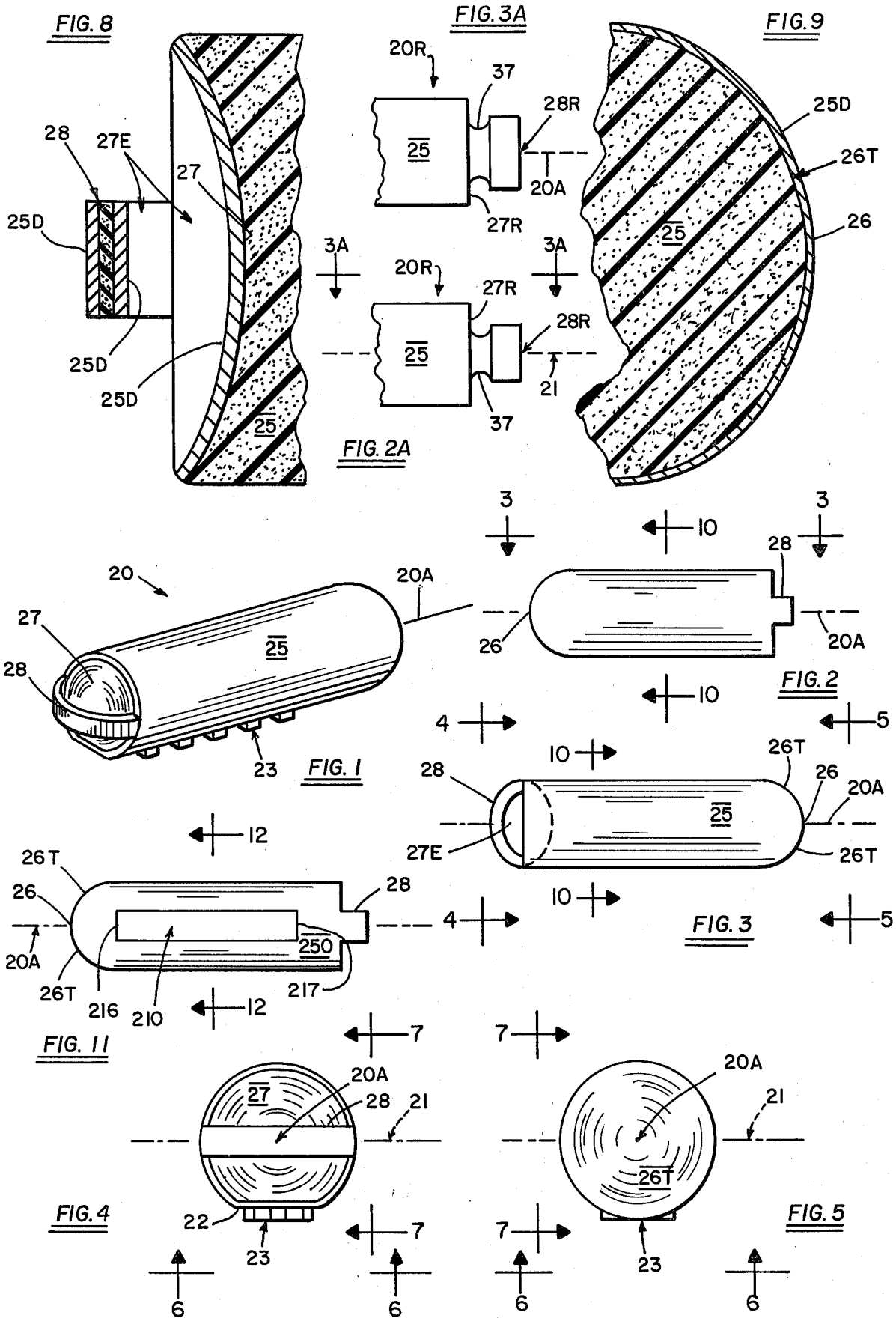
FIG. 1 is a perspective view taken in the top, rearward, and rightward directions of a first embodiment of the bolster type cushion of the present invention.
FIG. 2 is a left side elevational view of the first embodiment.
FIG. 3 is a top plan view of the first and of a second embodiment, taken along lines 3—3 of FIGS. 2,7, 10, and 12.
FIG. 4 is a rearward elevational view of the first and second embodiments taken along line 4—4 of FIG. 3.
FIG. 5 is a forward elevational view of the first and second embodiments taken along line 5—5 of FIG. 3.
FIG. 8 is a sectional plan view of rearward portions of the first and second embodiments taken along line 8—8 of FIG. 7.
FIG. 9 is a sectional plan view of the forward portion of the first and second embodiment taken along line 9—9 of FIG. 7.
FIG. 11 is analagous to FIG. 2 and is a left side elevational view of the second embodiment.
FIGS. 2A and 3A are left side elevational and top plan views, respectively, of an alternate embodiment 20R having an axial (20A) handle means 28R.

Representative first embodiment 20 of the bolster-type cushion is illustrated in FIGS. 1–10 and is predominately formed of a porous resiliently compressible body 25 surrounding and extending longitudinally along central-axis 20A. The cushion has a frontal lead-end 26 at central-axis 20A and a handle-like (e.g. 28) trail-end, said rearward handle facilitating grasp and cushion manipulation by the patient's attendant. Though the rearwardly extending handle means might be an entirely separate member mechanically attached to the rearward end 27 of body 25, the handle (28, 28R) is preferably in structurally continuous integral relationship with the body and extends rearwardly therefrom. There might be a space 27E for the attendant's fingers between handle style 28 and body end 27, the latter herein being depicted as concave.

As seen in the cross-sectional views of FIGS. 8–10 and 12, the cushion body along the major proportion of its longitudinal finite-length 26–27 has a dimensionally constant and regular geometric-shape, the geometrical circumference thereof surrounding central-axis 20A. The cushion external surface is comprised of the said cross-sectional circumference extending longitudinally, together with the frontal and rearward ends depicted in FIGS. 5 and 4, respectively. There are water-proof jacket means (e.g. 25D) extending along the entire external surface, said jacket means being devoid of water-pervious gaps whereby the cushion can be periodically immersed into or otherwise liberally washed with an acqueous cleansing medium without seapage of water into the pores of the resiliently compressive body (25, 250). Though the liquid-impervious jacket means might be provided by spraying adherent lacquer or the like onto the external surface, preferred are heat or other processes that provide a densified form of a resiliently compressible porous foamy resinous body (25, 250) whereby the jacket means consists of a densified non-porous surface skin 25D of the same resinous structural material. Empirical selection of the body material will result in a densified surface skin jacket means (25D) impervious to both non-acqueous and acqueous cleaning liquids.

Figure 10:
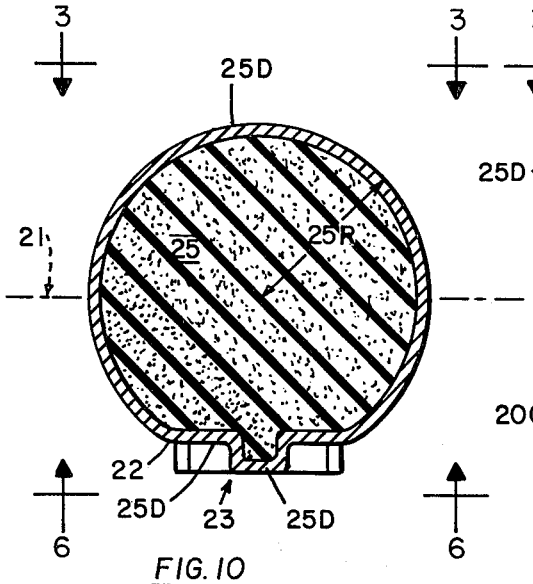
FIG. 10 is a sectional elevational view of the first embodiment taken along lines 10—10 of FIGS. 2 and 6.

Preferably, the cushion lower surface area includes stabilizer means for stabilizing the bolster-type cushion at its intended use site, such as the patient's sleeping bed surface, members of a convalescent's chair, etc. The cushion external surface includes a "lower surface area" defined to mean that portion of the external surface lying below a horizontal imaginary-plane 21 passing along horizontal central-axis 20A. One such stabilizer means might consist solely of a planar face portion (22) of the lower surface area and lying generally parallel to the imaginary-plane 21 thereabove. Another such stabilizer means might comprise surface irregularities such as tread means (23) that are either molded into the resinous body (25, 250) or adhered thereto as a separate strip-like laminar tread. More desirably, the tread means is attached to and depends from the longitudinally extending underface 22. In the preferred situation wherein the body (25, 250) is formed of a porous resinous compressive material, tread 23 is integrally molded therewith; in this vein, skin-like jacket means 25D preferably extends along the surface of tread design 23 as depicted in FIGS. 10 and 12.

It is desirable that the external surface of cushion body 25, 250, immediately rearwardly of the cushion lead-end 26, converges toward central-axis 20A thereby providing a leadwardly tapered (26T) cushion to facilitate insertion into a sleeve-like therapeutic environment. Such environments are disclosed in, though not limited to the therapeutic devices disclosed in U.S. Pat. Nos. 3,924,282 and 4,074,376.

Figure 12:
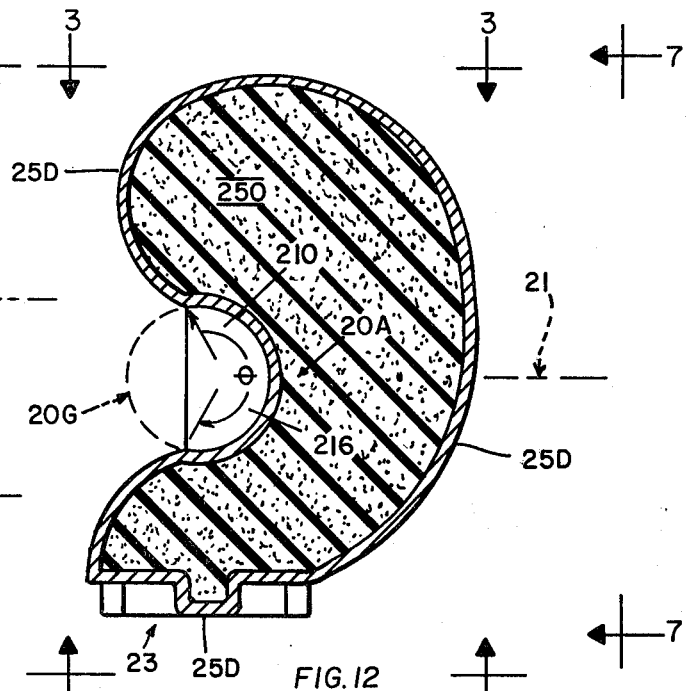
FIG. 12 is analagous to FIG. 10 and is a sectional elevational view of the second embodiment taken along lines 12—12 of FIG. 11.
Figure 6:
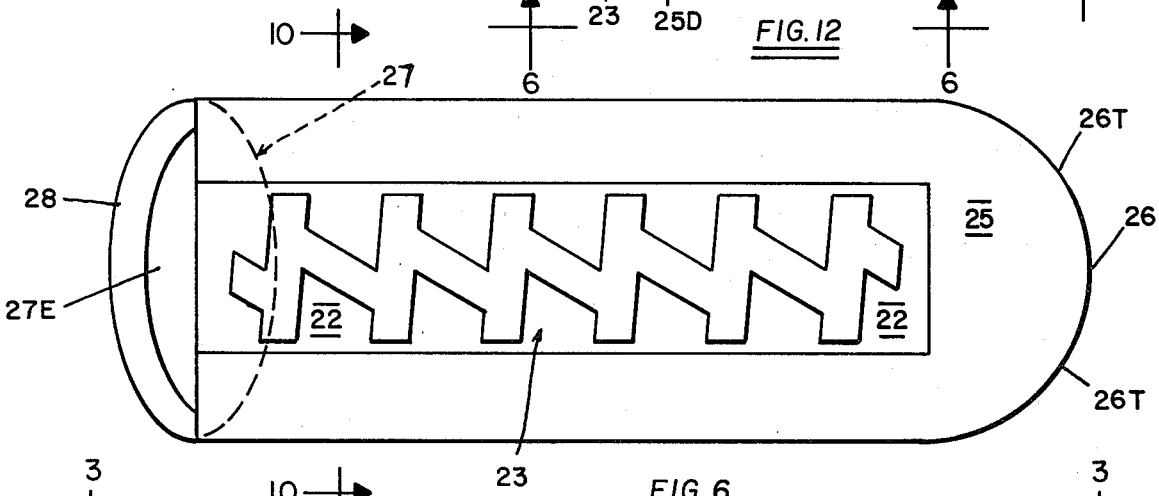
FIG. 6 is a bottom plan view of the first and second embodiments taken along lines 6—6 of FIGS. 4, 5, 10, and 12.
Figure 7:
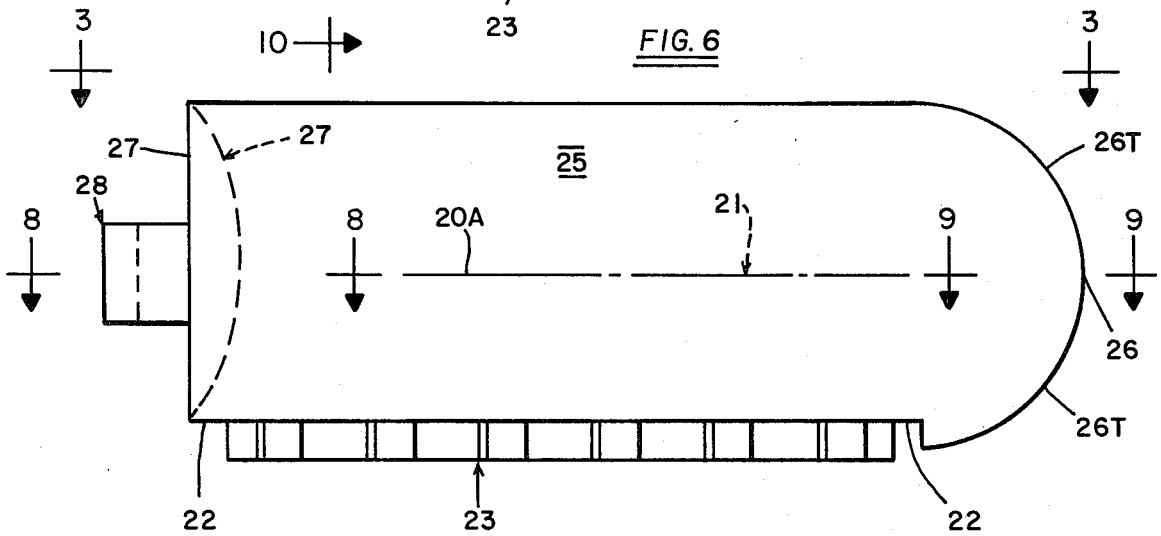
FIG. 7 is a right side elevational view of the first and second embodiments taken along lines 7—7 of FIGS. 4, 5, 10 and 12.

FIGS. 11 and 12 aptly indicate the main differences between embodiment 20 of FIGS. 1–10 and the second embodiment of FIGS. 3–12. As previously stated, for the major proportion of the cushion body longitudinal finite-length 26–27, the body (25, 250, etc.) cross-sectional shape is dimensionally constant and of regular geometric-shape with the geometric circumference surrounding central-axis 20A. Though in embodiment 20 the geometric shape is generally circularly cylindrical, for the second embodiment the geometric circumference is profoundly non-circular. As best seen in FIGS. 11 and 12, the second embodiment a very minor proportion (i.e. less than one-fourth) of the body cross-sectional circumference includes a concave portion (210) representing a sector of a circle having a angular value $\phi$ within the range of 190° to 290°. Such cross-sectional concavity (210) is linearly generated, thus providing a longitudinally lengthy sideward recessed channel 210. Channel 210 permits removably secure insertion thereinto of another longitudinally extending bolster-type cushion of some generic type, indicated by phantom line 20G. Such secondary bolster-type cushion 20G would normally be selected to have lesser resiliency than the primary and channeled cushion 250, thereby affording firmer spinal support to heavier weight patients. For less demanding therapeutic situations, the non-channel side (e.g. FIG. 7) of the second embodiment might instead be utilized against the patient, and for such situations, the secondary bolster 20G would be unnecessary.

The alternate handle means 28R for embodiment 20R of FIGS. 2A and 3A has a single necked connector 37 extending forwardly thereform along central-axis 20A and thence connected to body rear end 27R. Handle 28R in a rear elevational view is preferably elongate e.g. elliptical rather than circular, to facilitate handle grasping and cushion manipulation by the attendant. Moreover, the rearwardly seen elongation for handle 28R, depicted in FIGS. 2A–3A elongated along plane 21, affords the attendant a visual indicator means for ascertaining positioning of the stabilizer means (e.g. 23) and the recessed channel (e.g. 210).

From the foregoing, the construction and use of the bolster type cushions for therapeutic use will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

What is claimed is as follows:

1. A bolster-type cushion for therapeutic use, longitudinally extending for a finite-length between lead-end and trail-end along a central-axis, the cushion being predominately formed of a porous resilient structural material, the cushion along the major proportion of the finite-length cross-sectionally having a dimensionally constant and regular geometric-shape circumferentially surrounding the central-axis, the cushion having an external surface which commencing immediately rearwardly its lead-end diverges from the central-axis, said cross-sectional geometric-shape being non-cylindrical wherein a minor proportion of the circumference thereof includes a recessed channel in a circular shape having a sectorial extent within the range of 190° to 290°, and further comprising:

(a) handle means at the cushion trail-end; and (b) water-proof jacket means extending along the entire external surface, said jacket means being free of water-pervious gaps whereby the cushion can be periodically immersed into an acqueous cleansing medium without leakage of water into the pores of the resilient structural material of said cushion.

2. The cushion of claim 1 wherein the cushion is predominately formed of porous resilient structural material, said jacket means comprising a skin consisting of a densified form of the resilient structural material.

3. The cushion of claim 2 wherein the handle means is formed of said resilient structural material and is in structurally continuous integral relationship therewith.

4. The cushion of claim 3 wherein the rearward trail-end includes a concave recess located immediately forwardly the integral handle.

5. The cushion of claim 3 wherein the handle means in rearward elevation is non-circular to provide visual indicator means.

6. The cushion of claim 1 wherein the handle means includes a necked connector extending forwardly therefrom along said central-axis, the handle in rearward elevation being non-circular to provide visual indicator means and cushion manipulatability.

7. The cushion of claim 1, including a stabilizer means comprising a longitudinally extending, generally planar face with thread means depending therefrom.

* * * * *